United States Patent [19]

Sobel

[11] Patent Number: 4,721,225

[45] Date of Patent: Jan. 26, 1988

[54] PAINT BRUSH VALET

[76] Inventor: Edward J. Sobel, 2758 Olson Ave., Grand Junction, Colo. 81503

[21] Appl. No.: 17,816

[22] Filed: Feb. 24, 1987

[51] Int. Cl.[4] ..... B65D 25/00; B44D 3/12

[52] U.S. Cl. ..... 220/90; 15/257.05; 211/66; 248/110; 401/123

[58] Field of Search ..... 206/209; 211/65, 66, 211/113, 119; 248/110, 112, 113; 15/257 R, 257.05; 220/90; 401/121, 123

[56] References Cited

U.S. PATENT DOCUMENTS

| | | | |
|---|---|---|---|
| 778,272 | 12/1904 | Roop | 248/113 |
| 2,315,269 | 3/1943 | Morgillo | 248/110 |
| 2,369,335 | 2/1945 | Burman | 15/257.05 |
| 2,542,737 | 2/1951 | Vogel | 220/90 |
| 2,639,835 | 5/1953 | Nelson | 220/90 |
| 3,275,187 | 9/1966 | Lamoureaux | 220/90 |
| 3,948,413 | 4/1976 | Gorrell et al. | 220/90 |
| 4,014,453 | 3/1977 | Tarnacki | 220/90 |
| 4,025,206 | 5/1977 | Rubin | 248/112 X |

FOREIGN PATENT DOCUMENTS

| | | | |
|---|---|---|---|
| 972724 | 8/1975 | Canada | 220/90 |
| 2299167 | 1/1976 | France | 220/90 |
| 616926 | 1/1949 | United Kingdom | 220/90 |

*Primary Examiner*—Stephen Marcus
*Assistant Examiner*—Bryon Gehman

[57] ABSTRACT

Paint brush valet is a device having a semi-circular shaped base portion comprising a network of cross members which form a series of base openings for adequate paint drainage, a base supporting member and means to attach over the brim of the original and alternate paint containers. The device is utilized when the user retires from painting temporarily and places the free bristle end of a paint brush upon the base and leans the handle against the paint brush handle supporting member.

1 Claim, 2 Drawing Figures

PAINT BRUSH VALET

BACKGROUND OF THE INVENTION

This invention pertains to the mode of which a paint brush is placed when the user retires from painting temporarily.

If the user places the paint brush within a paint container and into the contained paint, the bristles will quickly become laden with paint and usually drip excess paint when painting is resumed. If the user leaves the paint brush in a place where the bristle ends are not into paint, and not within a container such as, for example, across the mouth of the paint container, bristles will become excessively dry and hard. If the user leaves the paint brush in an alternate container which contains no paint but has a solid bottom having no openings for paint drainage, paint which is upon and between the bristles will drain downwardly and congest at the bristle ends thereby causing paint to drip when the paint brush is removed from the alternate container and also when the user applies the paint brush to the surface being painted. Therefore, it is apparent that an ideal method of maintaining a paint brush in a favorable condition for painting for relatively short periods of time involves the placement of a paint brush within the paint container and above and not into the contained paint and upon a base comprising a series of base openings for paint that drains from the bristles, through the base openings, and into the paint contained below.

SUMMARY OF THE INVENTION

A paint brush valet, according to one embodiment of the present invention comprises a base portion being semi-circular in shape and having cross members which form a series of base openings for adequate paint drainage. The device also includes a base supporting upright member, a paint brush handle supporting member, and means to attach to the original and alternate paint containers.

DESCRIPTION OF THE PREFERRED EMBODIMENT

Figure 1:
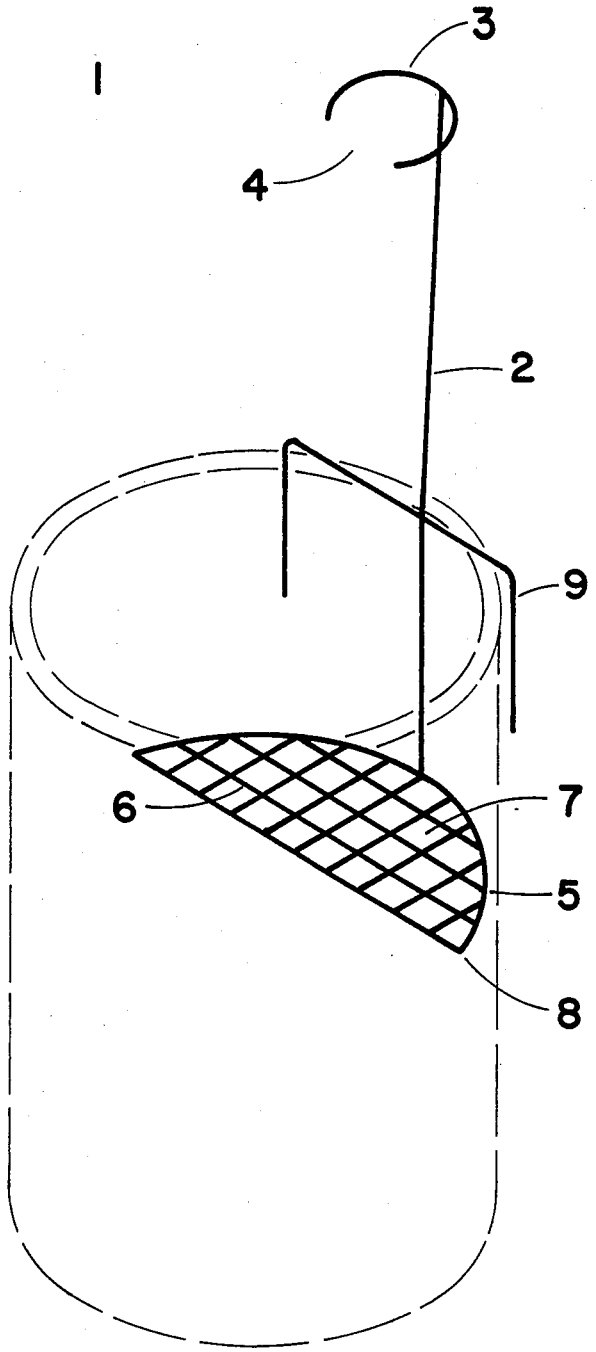
FIG. 1 is a perspective view of the present invention, paint brush valet.
Figure 2:
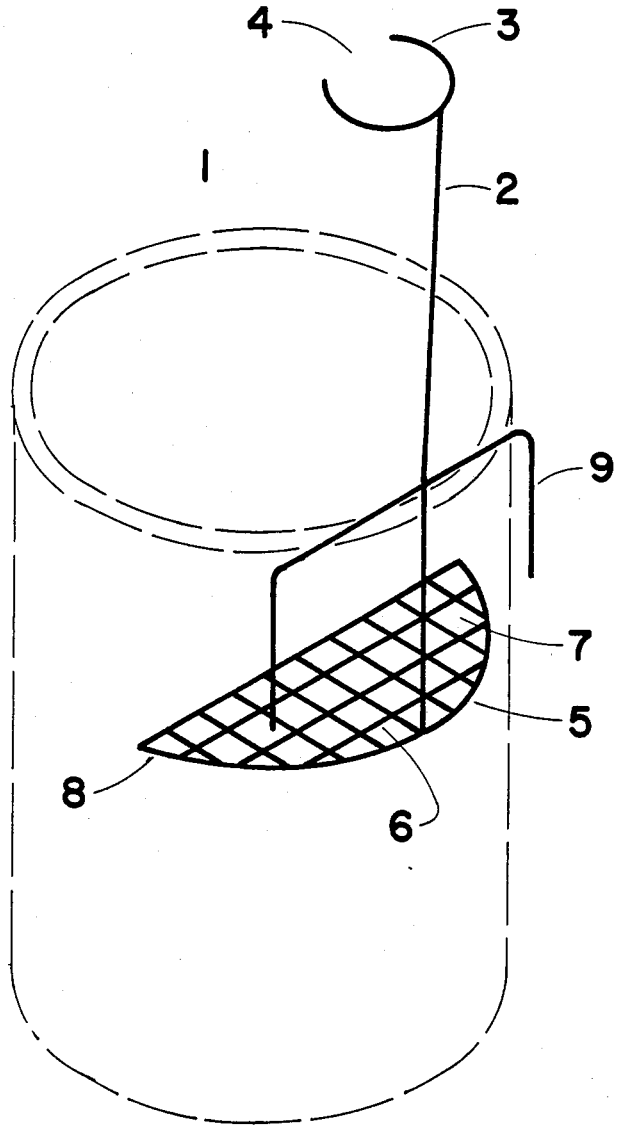
FIG. 2 is a rear view of the present invention.

For the purpose of promoting an understanding of the purposes of the invention, reference will now be made to the embodiment illustrated in the drawings and specific language will be used to describe the same. It will nevertheless be understood that no limitation of the scope of the invention is thereby intended, such alterations and further modifications in the illustrated device and such further applications of the principals of the invention as illustrated therein being contemplated as would normally occur to one skilled in the art to which the invention relates.

Referring to FIG. 1 there is illustrated a paint brush valet 1. The illustrated device is comprised of varied lengths of a flexible material such as, for example, rigid wire. Members of the device are joined together by a suitable metal-to-metal technique such as soldering.

The device includes an upright member 2 having a paint brush handle supporting member 3 attached to its top end and a rigidly suspended base portion 8 attached to its bottom end. Paint brush handle supporting member 3 is attached to the top end of upright member 2 and is in the general shape of a "c" with the open region 4 between the free ends providing the passageway for a portion of the handle of a paint brush. Upright member 2 extends downwardly from its top end to the base portion rear edge member 5.

The device includes attaching member 9 which is affixed to a rear upright member 2 at a point of attachment approximately two and one-half inches in an upwardly direction from the bottom end of member 2, extending thereat in a horizontal manner and outwardly away from member 2 in either direction approximately two inches, extending thereat in a downwardly direction approximately two inches. Attaching member 9 is placed over the brim of a paint container with a lower portion of upright member 2 and the base portion 8 being positioned inside of the paint container.

The device may be placed upon the original paint container from which a portion of the paint has been removed in order that the base portion 2 will be above and not into the contained paint, or the device may be placed upon an alternate container being preferred by the user. Base portion 8 being semi-circular in shape and grid-like in structure which comprises a network of base portion member 6 which form the base portion openings 7, which provide the means of drainage for the paint which drains from the free bristle ends of a paint brush. Paint drains from the bristles, passes through the base portion openings 7, and into the paint contained below the base portion 8; therefore the paint brush will be free of excess paint.

Said base portion is also utilized when the user retires from painting temporarily and places the bristle end of a paint brush upon the base and guides a portion of the paint brush handle through open region 4 and leans the handle against upright portion member 3.

While the inveniton has been illustrated and described in detail in the drawings and foregoing description, the same is to be considered illustrative and not restrictive in character, it being understood that only the preferred embodiment has been shown and described and that all changes and modifications that come within the spirit of the invention are desired to be protected.

What is claimed is:

1. In combination: a paint brush valet and a cylindrical paint container, the paint brush valet comprising a base portion member, said base portion member being substantially level and having a semi-circular shape generally conforming to the inner cylindrical wall of the paint container, said base being suspended substantially below a top access opening of said cylindrical paint container and extending horizontally and away from said inner cylindrical wall to the approximate center of said paint container, said base being in the form of a semi-circular grid defining a series of openings which provide passageways for paint drainage, a base supporting upright member extending upwardly from said base and protruding through said access opening, a paint brush handle supporting member affixed to said upright member above said access opening, and an attaching member affixed to said upright for attaching over the brim of the paint container.

* * * * *